US008212479B2

(12) United States Patent
Albrecht et al.

(10) Patent No.: US 8,212,479 B2
(45) Date of Patent: Jul. 3, 2012

(54) HIGH-PRESSURE DISCHARGE LAMP WITH IMPROVED INTENSITY DISTRIBUTION

(75) Inventors: Anton Albrecht, Gaimersheim (DE); Swen-Uwe Baacke, Neuburg/Donau (DE); Stephan Berndanner, Yokohama (JP); Michael Simson, Manching (DE); Martin Spreitzer, Schrobenhausen (DE)

(73) Assignee: Osram AG, München (DE)

( * ) Notice: Subject to any disclaimer, the term of this patent is extended or adjusted under 35 U.S.C. 154(b) by 122 days.

(21) Appl. No.: 12/373,683

(22) PCT Filed: Jul. 4, 2007

(86) PCT No.: PCT/EP2007/056761

§ 371 (c)(1),
(2), (4) Date: Jan. 13, 2009

(87) PCT Pub. No.: WO2008/006759

PCT Pub. Date: Jan. 17, 2008

(65) Prior Publication Data

US 2009/0261728 A1 Oct. 22, 2009

(30) Foreign Application Priority Data

Jul. 13, 2006 (DE) ..... 10 2006 032 450

(51) Int. Cl.
*H01J 17/18* (2012.01)

(52) U.S. Cl. ..... 313/623; 313/573; 313/634

(58) Field of Classification Search ..... 313/627–643, 313/56, 573, 634, 623, 331, 332
See application file for complete search history.

(56) References Cited

U.S. PATENT DOCUMENTS

| | | | | |
|---|---|---|---|---|
| 3,250,941 | A | 5/1966 | John et al. | |
| 4,463,281 | A | 7/1984 | Triebel et al. | |
| 5,663,607 | A | 9/1997 | Kira et al. | |
| 5,859,492 | A | 1/1999 | Austad et al. | |
| 6,054,811 | A * | 4/2000 | Genz et al. | 313/634 |
| 2006/0238127 | A1 | 10/2006 | Van Esveld et al. | |

FOREIGN PATENT DOCUMENTS

| | | | |
|---|---|---|---|
| DE | 30 29 824 | | 3/1982 |
| DE | 196 18 967 | | 11/1996 |
| EP | 0093383 | A2 | 4/1983 |
| EP | 093383 | * | 11/1983 |
| EP | 1 117 126 | | 7/2001 |
| EP | 1 117 126 | A1 | 7/2001 |
| EP | 1656690 | A2 | 5/2006 |
| JP | 360240049 | A * | 11/1985 |
| JP | 07-021988 | A | 1/1995 |
| JP | 08-77975 | A | 3/1996 |

(Continued)

*Primary Examiner* — Joseph L Williams
*Assistant Examiner* — Fatima Farokhrooz
(74) *Attorney, Agent, or Firm* — Cozen O'Connor

(57) ABSTRACT

A high-pressure discharge lamp having a discharge vessel with a central part that bulges out and which defines a lamp axis with a sealing part being attached to each end of the discharge vessel. The shaft of in each case one electrode, comprising a head and a shaft, is sealed in the sealing part, and a capillary tube closely surrounding the shaft of the electrode is between the central part of the discharge vessel and the sealing part. A tubular neck is integrally formed as a component of the discharge vessel between the central part and the capillary tube, and is separated from the shaft.

7 Claims, 4 Drawing Sheets

FOREIGN PATENT DOCUMENTS

| | | | | |
|---|---|---|---|---|
| JP | 8-315780 | A1 | | 11/1996 |
| JP | 10 284004 | | | 10/1998 |
| JP | 11-96969 | A | | 4/1999 |
| JP | 2001-15070 | A | | 1/2001 |
| JP | 2003151501 | | * | 5/2003 |
| JP | 2004-171888 | A | | 6/2004 |
| JP | 2005-340136 | A | | 12/2005 |
| JP | 2006-92865 | A | | 4/2006 |
| JP | 2006-179259 | A | | 7/2006 |
| WO | WO 2005 015603 | A2 | | 2/2005 |

* cited by examiner

HIGH-PRESSURE DISCHARGE LAMP WITH IMPROVED INTENSITY DISTRIBUTION

RELATED APPLICATIONS

This is a U.S. national stage of application No. PCT/EP2007/056761, filed on Jul. 4, 2007. This application claims the priority of German patent application no. 10 2006 032 450.1 filed Jul. 13, 2006, the content of which is hereby incorporated by reference.

BACKGROUND OF THE INVENTION

High-pressure discharge lamps for photo-optical purposes are produced using two sealing techniques—film or rod sealing. Discharge lamps using rod sealing are produced using so-called valve-seat or capillary sealing. One example of valve-seat sealing is DE-A 30 29 824. DE-A 196 18 967 discloses a high-pressure discharge lamp which uses a seal with capillaries as a support for the electrode system.

Until now, the loose support of capillary lamps—the capillary seal—has been formed directly adjacent to the lamp bulb. In addition to the formation of the loose support (capillary seal), the bulb must also be shaped by a shaping tool in the junction area between the bulb and the shaft. Discontinuities and undesirable deformation occur in the bulb wall, influencing the unimpeded emergence of light. The problem is illustrated in FIG. 1. In this case, the high-pressure discharge lamp 1 is equipped with a cathode 2 and an anode 3. The area of the capillary seal 4 has a circle around it. In this case, the ends of the bulging bulb 5 of the discharge vessel are passed over the shaft 6 of the two electrodes, which are connected to the electrical supply lines which project out of the inner part. The pump stalk 7 is seated at half the height directly on the bulb in the shadow of the anode. In the area of the capillary tube, the glass of the bulb is guided very close to the shaft of the electrode, in order to mechanically fix it. The actual sealing area is located behind this.

SUMMARY OF THE INVENTION

One object of the present invention is to provide a high-pressure discharge lamp for direct-current operation, having seals that are designed such that adverse effects on the optical characteristics are largely avoided.

This object is achieved by the characterizing features of claim 1.

Particularly advantageous refinements can be found in the dependent claims.

The electrode systems of discharge lamps which are sealed at two ends must be supported twice because of their own weight and because of the fact that the two electrode systems must be axially centered with respect to one another. The first support is provided by the seal of the electrode foot into the lamp bulb at the shaft end of the bulb. The second support is a so-called loose support, directly in front of the junction between the bulb shaft into the bulb shape which bulges out. The light yield from the discharge lamp is improved considerably by changing the loose support, particularly in the case of capillary lamps.

The capillary seal is moved according to an embodiment of the invention from the junction between the bulb and the shaft into the shaft area of the bulb. The junction area between the bulb and the shaft is therefore no longer deformed during the formation of the loose support. In addition, during production of the bulb, the bulb is formed further in the direction of the shaft tube in the cathode area, using a defined forming tool.

The advantage for the customer is an increased usable light yield. The increase in the light yield is 5-10% with the operating current, the filling pressure and the electrode separation remaining constant.

One aspect of the present invention is based on the idea that the shaping of the capillaries which are used as supports for the electrode system results in deformation occurring in the junction area between the capillary and the bulb. This cannot be avoided, even if the work is carried out very carefully. The light yield is impeded by this deformation, in particular in the bulb area on the cathode side. If this support is produced somewhat to the rear (in the region of the shaft area) and the bulb is formed further downwards in this region even while the bulb is being formed, particularly in the cathode area, this completely precludes deformation resulting from the formation of the capillary. In consequence, the bulb is not deformed in this area, the emitted light can emerge outwards without any impediment, and the light yield of the lamp can be increased in this way without any further adaptations, such as a change in the electrode separation or the filling pressure.

This idea preferably applies to a rod seal, although it can also be applied to a film seal.

In this case, the shaft is preferably exactly matched to the respective bushing system at the two ends of the bulb. Since the cathode is considerably smaller than the anode, the two shafts may have different diameters. This allows optimum matching without distortion of the bulb.

In particular, the ratio of the two diameters of the quartz tubes of the seals should be in the range from 1.2 to 1.6. In the case of a pinch, this means the maximum diameter. The external diameter of the tubular neck associated with the anode is approximately 1.2 to 1.6 times as large as the external diameter of the tubular neck associated with the cathode. The ratio of the diameter of the seal to the maximum diameter of the cathode is preferably in the range from 3 to 6. In the case of the seal on the anode side, this ratio is preferably in the range from 4 to 7.

One particular advantage of the novel seal is that the pump stalk can be fitted directly to the shaft tube. Particularly in the case of reflector lamps and reflector lights in which the lamp or the bulb is installed through the reflector, the pump stalk should not exceed the maximum diameter of the bulb. Particularly in the case of lamps with a capillary seal, the pump stalk should be fitted directly on the bulb, for process reasons, since, otherwise, it takes a very long time to pump the lamp out before filling. As a result of the requirement that the sealed pump stalk must not project beyond the bulb, this must in any case be pulled off short. However, this increases the risk of stresses which act on the bulb being formed during the melting-off process. However, if the pump stalk is moved to the shaft tube, it can be kept longer than if it were fitted to the bulb. This is particularly true in the case of lamps with a capillary seal.

BRIEF DESCRIPTION OF THE DRAWINGS

The invention will be explained in more detail in the following text with reference to a plurality of exemplary embodiments. In the figures.

PREFERRED EMBODIMENT OF THE INVENTION

Figure 1:
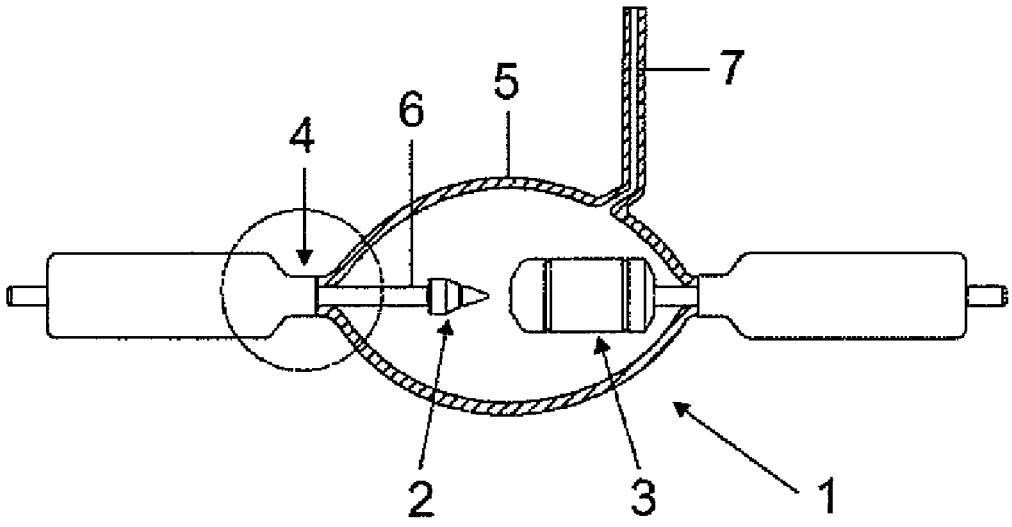
FIG 1 Prior Art
FIG. 1 shows a high-pressure discharge lamp according to the prior art.
Figure 2:
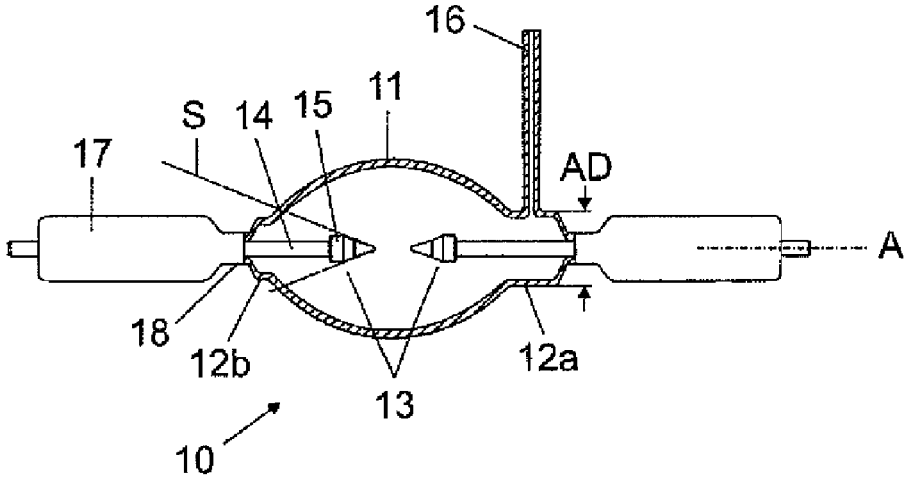
FIG. 2 shows a high-pressure discharge lamp with a pump stalk in the area of the seal.

FIG. 2 shows one exemplary embodiment of a high-pressure discharge lamp 10 according to the invention. The bulging bulb 11 has a tubular-cylindrical neck, as an extension 12, at each of its two ends. This is in each case located in the shadow S of the electrode 13. The electrode 13 has a shaft 14 and a head 15 which tapers to a point, for example tapering conically, and defines an aperture angle α with respect to the axis A. At least, it has a conically tapering section with an adjacent plateau towards the discharge. The two electrodes are identical. The neck 12 has an external diameter which corresponds approximately to three times to seven times the diameter of the shaft 14. The two necks 12*a*, 12*b* may have the same axial length, but they should not be longer than the length of that section of the shaft which projects into the discharge volume. The length can preferably also be different. In this case, the longer neck 12*b* has a pump stalk 16 attached to it transversely with respect to the axis A of the lamp, from which pump stalk 16 a pump connecting stub remains after melting off.

The neck merges abruptly into a capillary tube 18 whose internal diameter is closely matched to the diameter of the shaft 14 of the electrode, without the intention of achieving a gas-tight seal in this way. The length of the capillary tube is a few millimeters.

The actual sealing area 17 is adjacent to the capillary tube 18 on the outside and, for example, is provided by a rod seal, whose external diameter corresponds to approximately that of the neck. However, the nature of the actual seal is not relevant.

Figure 3:
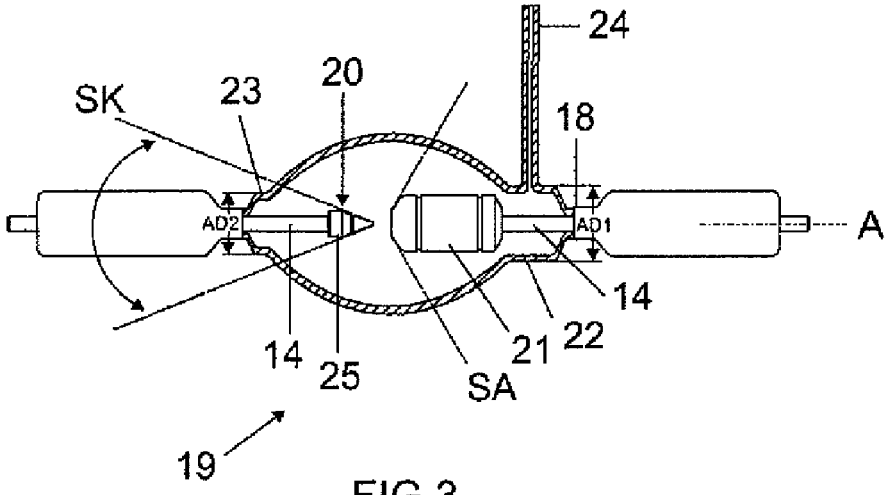
FIG. 3 shows a high-pressure discharge lamp with asymmetric seals.

FIG. 3 shows one particularly advantageous embodiment of a direct-current version of a high-pressure discharge lamp 19. In this case, the cathode 20 is smaller than the anode 21. Its head in each case comprises a part in the form of a roller and a tip which defines a certain angle α with respect to the axis A. This is in general different for the two electrodes. The dimensions of the two necks 22, 23 are in this case preferably different, to be precise such that both necks are located as completely as possible, but preferably up to at least 90%, in the respective shadows SA and SK of the associated tip, or its conical area, of the anode and cathode. The pump stalk 24 is also seated on a neck, to be precise preferably on the neck associated with the anode, since more space is available there. No supporting part or the like is arranged in the interior of the bulb in the area of the neck. This would otherwise adversely affect the operation of the pump stalk.

In the case of a 4000 W Xenon-filled lamp, the shaft 14 of the cathode has a diameter of 5.5 mm, the associated neck 23 has an external diameter of 24.5 mm. The ratio is 4.45. The axial length of the neck is 2 to 5 mm.

The shaft of the anode has a diameter of 5.5 mm, the associated neck 22 has an external diameter of 29.5 mm. Its axial length is 10 to 20 mm. The ratio of the diameter of the two necks is 1.2. The ratio of the diameter of the neck to the diameter of the shaft is 4.45 for the cathode, and 5.36 for the anode.

In contrast, the external diameter of the capillary tube 18 is the same at both ends. Its external diameter is in each case 10 to 13 mm.

Figure 4:
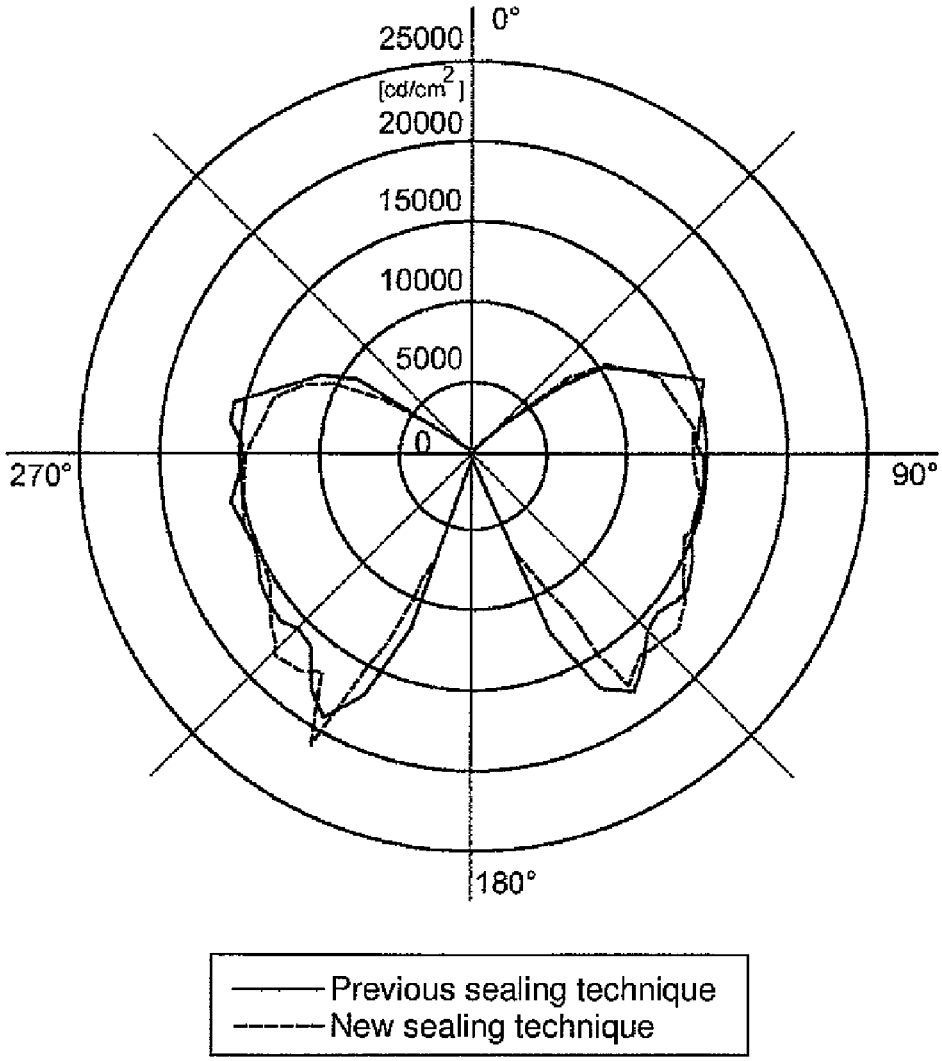
FIG. 4 shows the emission characteristic of a lamp as shown in FIG. 3.

This considerably improves the optical distortion of the bulb. FIG. 4 shows, in detail, the emission characteristic of a previous lamp and of a lamp according to the invention. With the new technique of the adapted necks, considerably more light is produced in the direction towards the 180° axis. In addition, the intensity distribution is more symmetrical overall.

Figure 5:
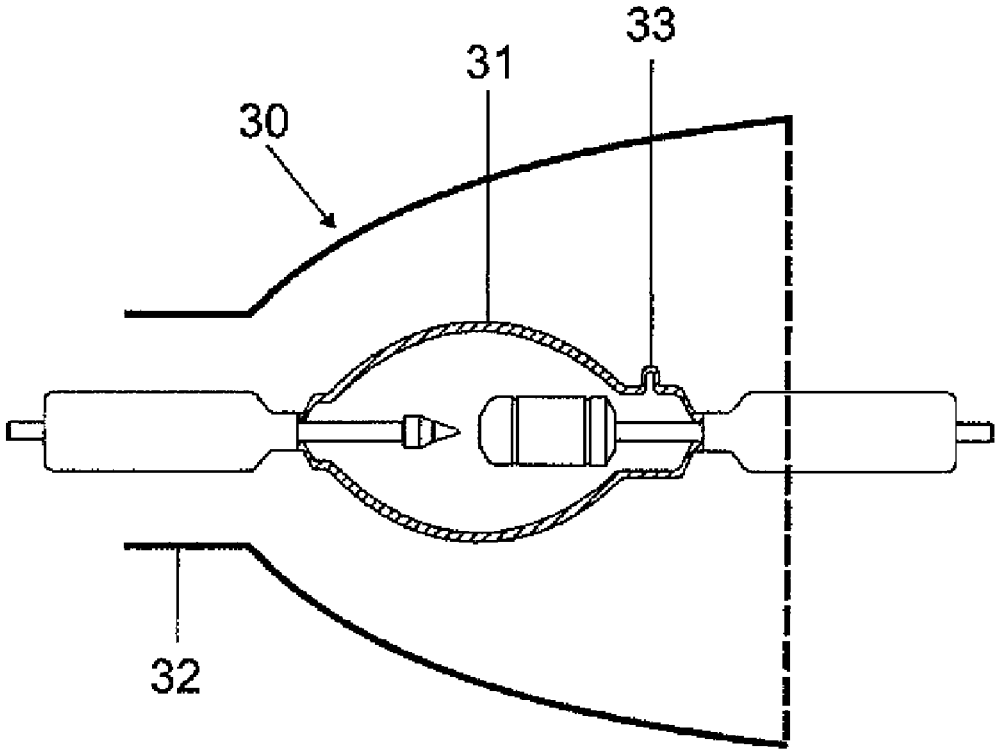
FIG. 5 shows one exemplary embodiment of a reflector lamp.

FIG. 5 shows a reflector lamp 30 with the bulb 31 which is seated axially in the opening in the reflector neck 32. It is inserted from the rear i.e. from the neck 32, in which case the pump connecting stub 33 can be left relatively long as it is no longer seated directly on the bulb. The pump stalk has been melted off after the filling process, as a result of which only a short pump connecting stub now remains on the neck. The opening in the neck 32 can thus be closely matched to the maximum diameter of the bulb 31.

The invention claimed is:

1. A high-pressure discharge lamp having a discharge vessel with a central part that bulges out and which defines a lamp axis with a sealing part being attached to each end of the discharge vessel, with the shaft of in each case one electrode, comprising a head and a shaft, being sealed in the sealing part, and with a capillary tube for supporting the electrode by closely surrounding the shaft of the electrode between the central part of the discharge vessel and the sealing part, wherein a tubular neck is integrally formed as a component of the discharge vessel at the each end of the discharge vessel between the central part and the capillary tube, and is separated from the shaft, wherein the lamp is a direct-current lamp, having a cathode and an anode as electrodes, the cathode being smaller than the anode, and wherein the external diameter of the tubular neck associated with the anode is approximately 1.2 to 1.6 times as large as the external diameter of the tubular neck associated with the cathode.

2. The high-pressure discharge lamp as claimed in claim 1, wherein, on the discharge side, the head of the electrode has a section which tapers conically and whose extension defines an electrode shadow, with at least the majority of the neck being arranged in the area of the shadow.

3. The high-pressure discharge lamp as claimed in claim 1, wherein a pump connecting stub is attached to one of the two necks.

4. The high-pressure discharge lamp as claimed in claim 1, wherein the external diameter of the neck associated with the cathode is about 3 to 6 times as large as the diameter of the shaft of the cathode.

5. The high-pressure discharge lamp as claimed in claim 1, wherein the external diameter of the neck associated with the anode is approximately 4 to 7 times as large as the diameter of the shaft of the anode.

6. The high-pressure discharge lamp as claimed in claim 1, wherein a pump connecting stub is attached to the neck which is associated with the anode.

7. The high-pressure discharge lamp as claimed in claim 2, wherein the neck is arranged completely in the area of the shadow.

* * * * *